US005628285A

United States Patent [19]

Logan et al.

[11] Patent Number: 5,628,285

[45] Date of Patent: May 13, 1997

[54] DRAIN VALVE FOR A MARINE ENGINE

[75] Inventors: Andrew K. Logan, Stillwater, Okla.; Matthew W. Jaeger, Fond du Lac., Wis.; Terry D. Axton; William E. Hughes, both of Stillwater, Okla.; David J. Gruenwald, Butle des Monts, Wis.; James E. Erickson, Stillwater, Okla.

[73] Assignee: Brunswick Corporation, Lake Forest, Ill.

[21] Appl. No.: 521,746

[22] Filed: Aug. 31, 1995

[51] Int. Cl.[6] ..... F01P 11/02

[52] U.S. Cl. ..... 123/41.14; 440/88; 137/62

[58] Field of Search ..... 123/41.14; 440/88, 440/900; 137/62, 79

[56] References Cited

U.S. PATENT DOCUMENTS

| | | | |
|---|---|---|---|
| 4,082,068 | 4/1978 | Hale | 123/41.02 |
| 4,541,448 | 9/1985 | Kolze | 137/62 |
| 4,693,690 | 9/1987 | Henderson | 440/88 |
| 4,758,190 | 7/1988 | Van Buren | 440/88 |

OTHER PUBLICATIONS

"Dole Freeze Protection Valve", Easton Corporation.

*Primary Examiner*—Noah P. Kamen
*Attorney, Agent, or Firm*—Andrus, Sceales, Starke & Sawall

[57] ABSTRACT

A drain valve assembly for automatically draining water from a cooling system of an inboard marine engine when the ambient temperature drops to a preselected value. The drain valve includes a cup-shaped base having a group of inlets connected to portions of a cooling system of the engine to be drained, and the open end of the base is enclosed by a cover. Each inlet defines a valve seat and a sealing piston is mounted for movement in the base and includes a series of valve members that are adapted to engage the valve seats. An outlet is provided in the sidewall of the cup-shaped base. The valve members on the sealing piston are biased to a closed position by a coil spring and a temperature responsive element interconnects the sealing piston with the cover. The temperature responsive element is characterized by the ability to exert a force in excess of the spring force of the coil spring when the ambient temperature is above about 50° F., to thereby maintain the valve members in the closed position. When the temperature falls below the selected temperature, the temperature responsive element will retract, thereby permitting the valve members to be opened under the influence of the spring to automatically drain water from the cooling system of the engine.

16 Claims, 2 Drawing Sheets

DRAIN VALVE FOR A MARINE ENGINE

BACKGROUND OF THE INVENTION

A conventional inboard or inboard/outboard (stern drive) marine engine utilizes a cooling system in which seawater is drawn from the lake or other body of water, circulated through the cooling system and then discharged overboard. More specifically, a typical cooling system for a V-6 inboard marine engine draws seawater into the cooling system by operation of a pickup pump, and the water is directed to a thermostat housing that contains a thermostat. When the thermostat is closed, a portion of the incoming seawater will be pumped by a circulating pump through outlets in the thermostat to the engine block and heads, while a second portion of the seawater will be by-passed to the exhaust manifolds. When the thermostat is open, the cooling water will flow to the engine block and heads and then will flow to the exhaust manifolds, and then overboard in the exhaust of the engine.

When the engine is not operating, water will collect in certain portions of the cooling system, such as the manifold, engine block and circulating pump. If the ambient temperature drops below freezing for extended periods, the collected water can freeze, which can cause cracking of the engine block of other components of the engine. Because of this, it is customary to winterizing the engine at the outset of cold weather. The winterizing operation is difficult and time consuming, as it normally requires draining of all the water from the engine, refilling with antifreeze, fogging the cylinders with lubricant.

Because of the danger of freezing, a marine engine is normally winterized well before the onset of freezing weather, and this substantially reduces the overall boating season.

SUMMARY OF THE INVENTION

The invention is directed to a drain valve assembly associated with an inboard marine engine for automatically draining water from the cooling system when the ambient temperature decreases below a preselected value, such as about 50° F.

In accordance with the invention, the drain valve includes a cup-shaped body or housing, and a group of inlets are mounted in the body and are connected through hoses or conduits to portions of the cooling system to be drained, such as for example, the exhaust manifolds, the engine block, and the circulating pump.

The open upper end of the body is enclosed by a cover and a drain outlet is provided in the side wall of the body.

Each inlet in the body defines a valve seat and a sealing piston, preferably formed of a resilient material, is mounted for sliding movement in the body and includes a series of valve members which are adapted to engage the valve seats.

The sealing piston is mounted on a support piston or plate that is located with the body and a coil spring interconnects the support piston with the body, thus urging the valve members to an open position.

In addition, a temperature responsive element interconnects the sealing piston with the cover. The element contains a quantity of wax which is capable of expanding and contracting when exposed to a specified ambient temperature range. The mass of wax is operably connected to a piston or plunger, which is mounted for sliding movement in the element and the outer or distal end of the plunger is engaged with the cover.

When the ambient temperature is above a preselected value, such as about 50° F., the plunger of the element will be extended, thus holding the valve members in a closed position against the force of the coil spring. When the temperature falls below 50° F., the plunger of the element will retract, thus enabling the valve members to be opened under the influence of the spring pressure. When the temperature falls to a value of about 40° F., the valves will be completely open, thereby automatically allowing water collected in the cooling system of the various engine components to be drained into the inlets in the body and then out through the outlet for discharge through the engine exhaust.

The drain valve of the invention also can incorporate an overtravel spring which is connected between the support piston and the sealing piston. As the temperature responsive element has some limited movement at temperatures above 50° F., the overtravel spring will compensate for this limited movement to prevent over compression of the valve members on the sealing piston.

Through use of the mechanism of the invention, the cooling system of the inboard marine engine will be automatically drained when the ambient temperature falls below a preselected value, such as about 50° F. Thus, there is no danger of freeze up due to unexpected cold snaps. It should be recognized, however, that the drain valve of the invention is not intended to replace the normal winterizing of the engine, but merely protects against cold snaps to lengthen the boating season.

When the ambient temperature is above the preselected temperature of 50° F., the drain valve will be closed so that no draining will occur, and the cooling system of the engine will operate in a normal manner.

Other objects and advantages will appear during the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
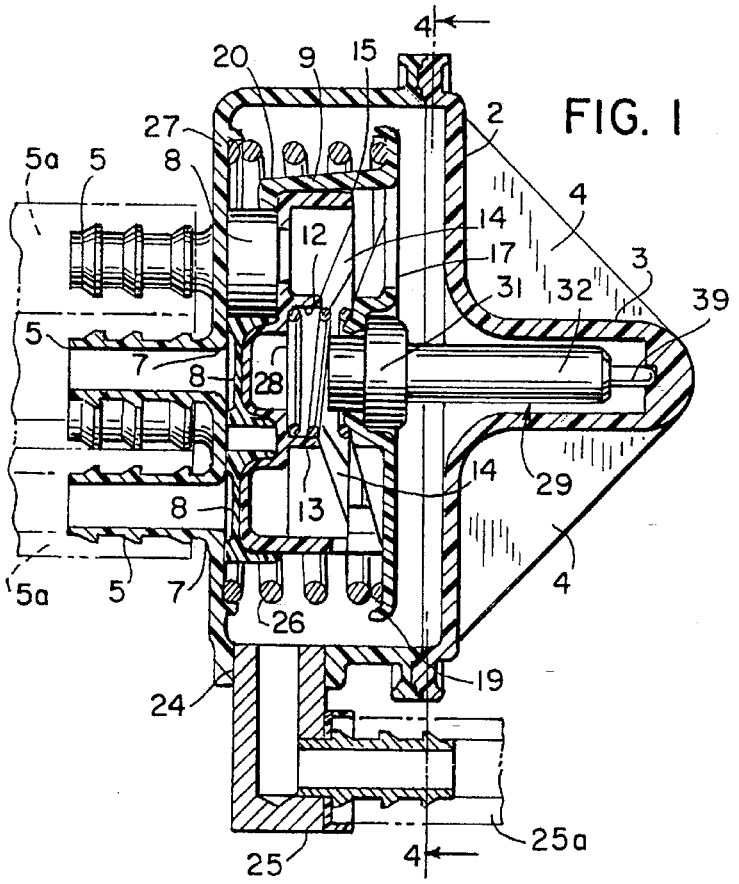
FIG. 1 is a longitudinal section of the drain valve of the invention, with the valve members being shown in the closed position.

FIGS. 1–5 show a drain valve to be mounted on the lower portion of an inboard marine engine for automatically draining water from the engine cooling system when the temperature falls below a predetermined value, such as about 50° F.

The drain valve includes a cup-shaped body or housing 1, the open end of which is enclosed by a cover 2. Cover 2 is provided with a central elongated projection 3 that defines an internal recess, and a series of reinforcing webs 4 are connected between the projection 3 and the peripheral edge of the cover.

The base or bottom surface of body 1 is provided with a plurality of inlet nipples 5, each of which receives a hose or conduit 5*a*. The hoses 5*a* are adapted to be connected to various portions of the cooling system of the engine to drain water from those portions to the body 1 of the drain valve. As an example, with a V-6 engine, two of the hoses 5*a* can be connected to the exhaust manifolds, while a second pair of hoses 5*a* can connect the inlets 5 with the port and starboard sides of the engine block and a further hose can connect one of the inlets 5 to a hose leading to the circulating pump. While the drawings show the axes of inlets 5 being horizontal, the body can be oriented in other manners as long as the inlets are at a level below the portions of the cooling system to be drained so that the cooling water will drain by gravity to the inlets.

In addition to the inlets 5, the base of the body 1 is provided with a central, outwardly extending, elongated projection 6. Projection 6 is closed and constitutes a sprue for molding the body 1. However, in certain instances, a hole can be drilled through the projection 6, so that the projection then will also constitute a further inlet to be connected to a portion of the cooling system of the engine.

The base of body 1, bordering each inlet 5, constitutes a valve seat 7 that is adapted to be engaged by a resilient valve member 8. Each valve member 8 is mounted on a projection on sealing piston 9 and is provided with a tapered peripheral edge that engages valve seat 7. Sealing piston 9 also includes a central projection that carries resilient valve member 10, which is adapted to engage an opening in the central projection 6 of the body if the central projection is provided with an inlet passage.

The surface of sealing piston 9 opposite the valve members 8 is formed with a central recess 12 that is bordered by a circular flange 13. A plurality of reinforcing ribs 14 extend radially between flange 13 and the peripheral flange 15 of the sealing piston.

Figure 5:
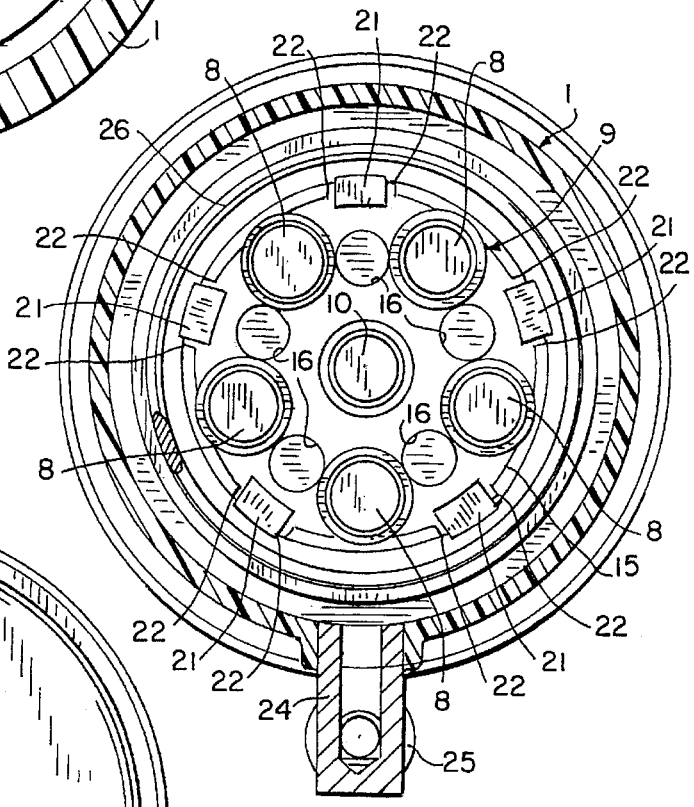
FIG. 5 is a section taken along line 5—5 of FIG. 2.
Figure 6:
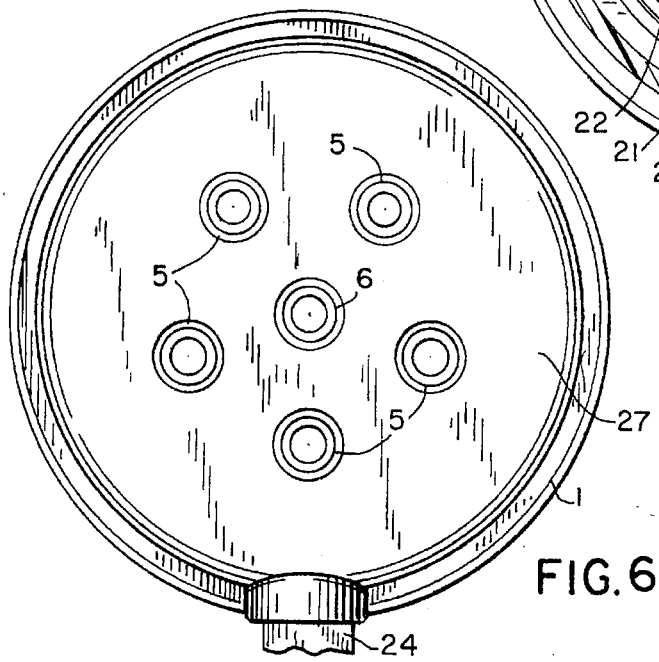
FIG. 6 is an end view of the drain valve.

As shown in FIG. 5, sealing piston 9 is provided with a plurality of holes 16 which are spaced between valve members 8. Holes 16 merely reduce the weight of the sealing piston and provide no function in the operation of the piston.

The sealing piston 9 is supported by a rigid support piston 17. Support piston 17 is provided with a central opening that is bordered by a flange 18 and flange 18 mates with the central recess 12 in the sealing piston.

Support piston 17 is formed with an upper flat surface bordered by a peripheral flange 19, and a series of flexible legs 20 extend outwardly from the flat surface of the support piston and are spaced radially inward of the peripheral flange 19. The outer or distal end of each leg 20 is provided an inward radially extending tab 21.

In assembling the resilient sealing piston 9 with the support piston 17, legs 20 are received within parallel ribs 22 on the outer periphery 15 of the sealing piston and the tabs 21 engage the annular edge of the sealing piston to thereby connect the sealing piston with the support piston 17.

The upper surface of support piston 17 can be formed with a series of holes 23 which, as shown, are aligned with the holes 16 in the sealing piston.

An outlet 24 is formed in the side wall of the cup-shaped body 1, and a generally L-shaped fitting 25 is connected to outlet 24. In practice, fitting 25 may be molded integrally with outlet 24. A suitable hose or conduit 25*a* can be connected to fitting 25 to conduct water from the drain valve to overboard through the engine exhaust.

To bias the valve members 8 to the open position, a coil spring 26 is interposed between the bottom surface or base 27 of body 1 and the peripheral edge of the support piston 17. The force of spring 26 will urge the support piston 17, along with the connected sealing piston 9, in a direction toward cover 2, thus biasing the valve members 8 to the open position.

In addition to the larger coil spring 26, a smaller overtravel spring 28 is seated in recess 12 of the sealing piston 9 and engages the support piston 17 at a location bordering the flange 18. Spring 28 has a lesser force than spring 26, and serves to compensate for overtravel of the temperature responsive element, as will be hereinafter described.

Figure 3:
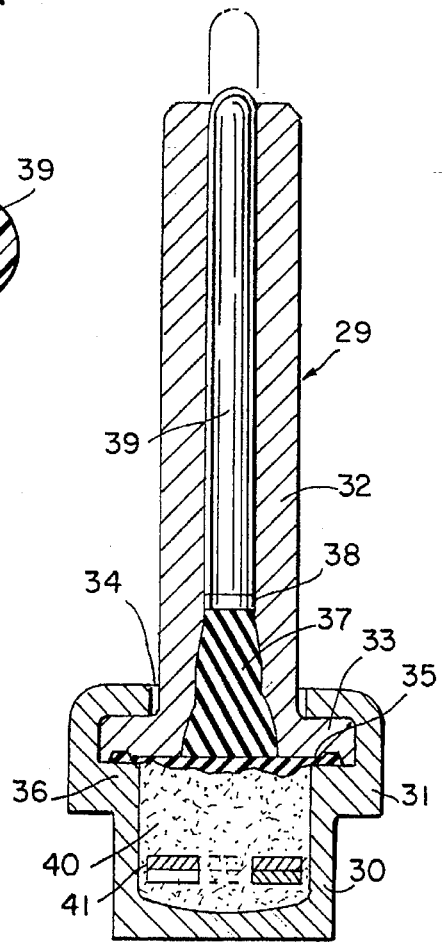
FIG. 3 is a fragmentary longitudinal section of the temperature responsive element.

The drain valve of the invention also includes a temperature responsive element 29 which is best shown in FIG. 3. Element 29 includes a generally cup-shaped base 30, which is mounted within the central opening of support piston 17 and an enlarged section 31 of base 30 rests against flange 18 on the support piston. An elongated tubular guide 32 extends outwardly from base 30, and an annular flange 33 on the inner end of guide 32 is located within the annular peripheral edge 34 of the base section 31, as shown in FIG. 3. Mounted between the inner surface of flange 33 and a shoulder 36 on base 30 is a flexible diaphragm 35.

Located within the inner end of the central passage of guide 32 is a plug 37 formed of a material, such as silicone oil, and a disc 38 is located between the plug 37 and a plunger 39 which is mounted for sliding movement within guide 32.

A mass of wax 40 is contained within base 30, and is exposed to the diaphragm 35. One or more metal washers 41 can be imbedded within wax 40 to increase the transfer of heat throughout the mass of wax.

The element 29 in itself is a conventional type and the wax is characterized by the ability to provide a substantial expansion and contraction within a specific temperature range to thus move the plunger 39. The outer end of plunger 39 is located within the recess defined by projection 3 of cover 2.

As the ambient temperature drops below a preselected value, such as 50° F., the mass of wax 40 will contract, causing plunger 39 to retract under the force of the coil spring 26. Valve members 8 will then open under the force of the spring 26 to permit cooling water in hoses 5*a* to drain into the inlets 5 of body 1, and the water will then be discharged through the outlet 24 and hose 25*a* to overboard.

The wax used in the valve member has an operating temperature range of approximately 40° F. to 50° F. and provides a plunger motion of approximately 0.300 inches within this operating temperature range under a 20 pound load and a 19 lb/in. spring rate.

As the temperature rises above 50° F., there will be some further expansion of the wax 40 and a corresponding movement of the plunger 39 of approximately 0.0009 inch per °F. To compensate for this travel at temperatures above 50° F., overtravel spring 28 provides resiliency to prevent over compression of the sealing piston 9 and valve members 8.

Under ambient temperature conditions above 50° F. the valve members 8 will be in the closed position as shown in FIG. 1. In this condition the plunger 39 is extended bearing against the cover 2 to hold the valve members 8 in the closed position against the force of spring 26.

Figure 2:
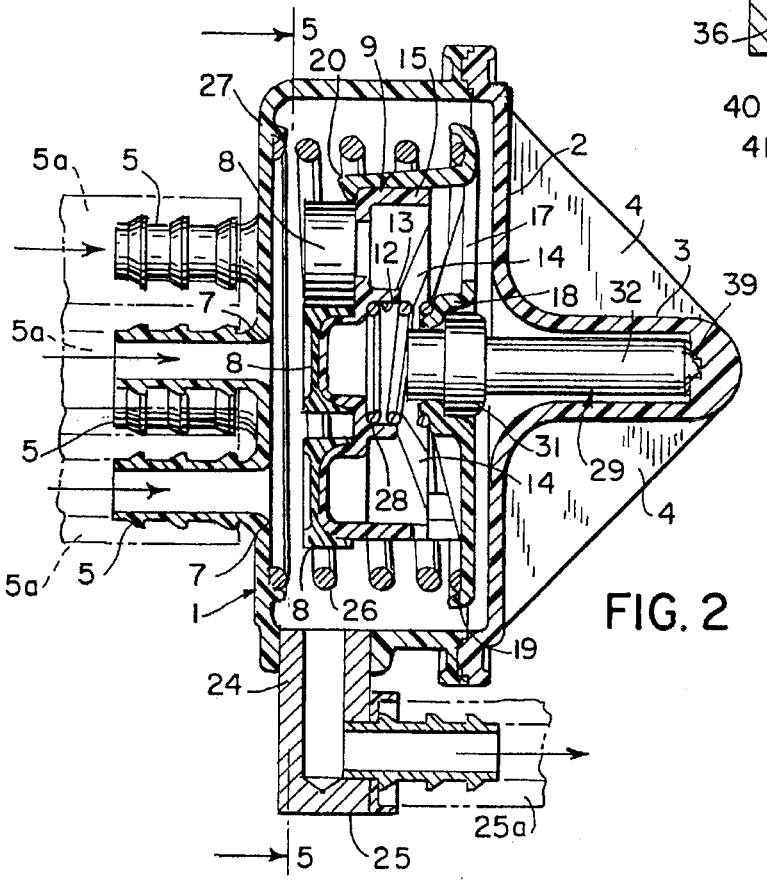
FIG. 2 is a view similar to FIG. 1 showing the valve members in the open position.
Figure 4:
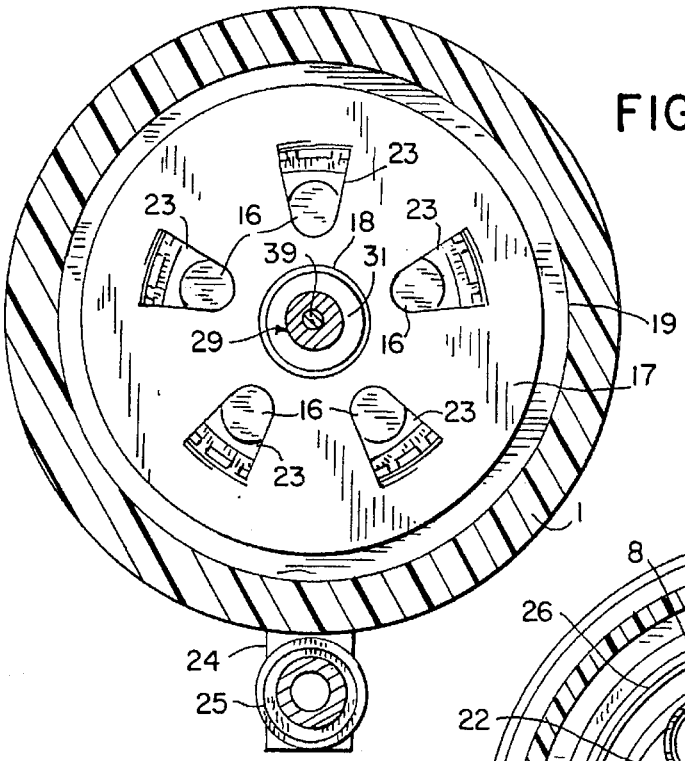
FIG. 4 is a section taken along line 4—4 of FIG. 1.

If the ambient temperature falls below the selected temperature of about 50° F., the mass of wax 40 will contract, causing plunger 39 to retract under the opposing force of spring 26, and the spring will then begin to open the valve members 8 to permit the water to drain through the inlets 5 to the body and then through the outlet 24. When the ambient temperature reaches a value of about 40° F., the valve members 8 will be in the fully open position as shown in FIG. 2, with the flat outer face of guide 32 engaged with the projection 3 of cover 2.

If the engine is started when the ambient temperature is below 50° F. and the valve members 8 are open, a minor portion of the seawater being drawn into the cooling system will be directed through hoses 5*a* to the open drain valve. However, as the engine continues to operate the mass of wax 40 will be heated to above 50° F., thus extending plunger 39 and closing the drain valve even though the ambient temperature may be below the selected temperature range.

The body 1, cover 2 and other components of the valve, are preferably formed of plastic, stainless steel, or other corrosion resistant materials.

The invention provides a mechanism for automatically draining the cooling system of an inboard marine engine when the temperature falls below a selected temperature such as 50° F., so that there is no danger of freezing of any water collected in the cooling system due to an unexpected cold snap. Once the temperature rises above the preselected value, the drain valve will close and the engine will operate in a normal manner.

As previously noted, the invention is not intended to replace the normal winterization that is required with an inboard engine, but is intended to protect against cold snaps to lengthen the boating season.

We claim:

1. A drain valve assembly for automatically draining water from the cooling system of a marine engine, comprising, a body having at least one inlet connected to a portion of a cooling system of a marine engine to be drained, said body also having an outlet, valve means disposed in the body and disposed to open and close said inlet, a portion of said body bordering said inlet defining a valve seat and said valve means comprises a resilient valve member disposed to engage said seat, biasing means connected to the valve means for biasing said valve member to an open position whereby water from the cooling system can enter the body through said inlet and will be discharged through said outlet; and a temperature responsive element disposed in the body and operably connected to said valve member, said temperature responsive element being characterized by the ability to exert a force on said valve member in excess of the force of said biasing means when the ambient temperature is above a preselected temperature to maintain said valve member in a closed condition, and to exert a force on said valve member less than the force of said biasing means when the ambient temperature falls below said preselected temperature to thereby permit said valve member to open under the influence of said biasing means.

2. The assembly of claim 1, wherein said body includes a cup-shaped base member having an open end and a cover enclosing the open end.

3. The assembly of claim 2, wherein said temperature responsive element is connected between said cover and said valve means.

4. The assembly of claim 1, wherein said biasing means comprises a coil spring connected between said valve means and said body.

5. The assembly of claim 4, wherein said valve means also includes a rigid valve support member to support said valve member, said spring being connected between said valve support member and said body.

6. The assembly of claim 5, wherein said valve member includes a shoulder and said valve support includes a plurality of flexible tabs disposed to engage said shoulder to thereby connect said valve member to said valve support.

7. The assembly of claim 1, wherein said temperature responsive element comprises a casing containing a mass of material capable of substantial expansion and contraction within a preselected temperature range, and a plunger slidable relative to the casing and operably connected to said mass, said plunger being engaged with said body and said casing being engaged with said valve means.

8. The assembly of claim 7, and including a flexible diaphragm interconnecting said plunger and said mass of material.

9. The assembly of claim 7, wherein said body includes a cup-shaped base member having an open end, and a cover enclosing said open end, said plunger being engaged with said cover.

10. The assembly of claim 9, wherein said cover includes an outwardly extending projection defining an internal recess, said plunger being disposed within said internal recess.

11. A drain valve assembly for automatically draining water from a cooling system of an inboard marine engine, comprising a housing having a pair of opposed surfaces, a first of said surfaces having a plurality of inlets each connected to a portion of a cooling system of the marine engine to be drained, said housing also having an outlet, a portion of the first of said surfaces bordering each inlet defining a valve seat, valve means disposed in said housing and including a plurality of valve members each disposed to engage a valve seat, resilient biasing means interconnecting the housing and said valve means for biasing the valve members to an open position to thereby permit water to drain through said inlets to said housing and then be discharged through said outlet, and a temperature responsive element disposed in the housing and interconnecting said valve means and said second surface of the housing, said temperature responsive element including a first member and a movable second member mounted for movement relative to said first member, said temperature responsive element also including a mass of material characterized by the ability to expand and contract when exposed to a preselected temperature range and connected to said second movable member, said mass of material exerting a force through said second movable member in excess of the force of said biasing means when the ambient temperature is above said preselected temperature range to maintain the valve members in a closed position and to exert a force less than the force of the biasing member when the temperature falls below said preselected temperature range to thereby permit said valve members to open under the influence of said biasing means.

12. The assembly of claim 11, wherein said valve means also includes a rigid valve support member, said resilient biasing means being connected between said valve support member and said body.

13. The assembly of claim 12, and including an overtravel spring disposed between said valve members and said valve support member for compensating for movement of said second movable member at temperatures above said preselected temperature range.

14. A marine engine comprising, an internal combustion engine having a plurality of water cooling passages each containing cooling water, a drain valve assembly mounted adjacent the lower portion of the engine beneath said cooling passages, said assembly including a housing having a plurality of inlets and an outlet, conduit means connecting each inlet with one of said cooling passages, each inlet defining a valve seat, valve means disposed within the housing and including a plurality of valve members each disposed to engage a valve seat to thereby prevent flow of water through said inlets to said housing, and actuating means responsive to a preselected ambient temperature above the freezing point of water for moving said valve means and opening said valve members to thereby permit water from said cooling passages to flow through said inlets to said housing and then through said outlet to a discharge site.

15. The marine engine of claim 14, wherein said inlets are arranged in a circular pattern, and said actuating means is disposed centrally of said circular pattern.

16. A drain valve assembly for automatically draining water from a cooling system of an inboard marine engine, comprising a housing including a cup shaped base member having an open end and a cover enclosing said open end, said base member having at least one inlet connected to a portion of a cooling system of a marine engine to be drained, said housing also having an outlet, a portion of said base member bordering said inlet defining a valve seat, valve means disposed in said housing and including a valve member disposed to engage said valve seat, biasing means connected to the valve member for biasing said valve member to an open position whereby water from the cooling system can enter the housing through said inlet and will be discharged through said outlet, and a temperature responsive element disposed in the housing and operably connected to said valve member, said temperature responsive element being characterized by the ability to exert a force on said valve member in excess of the force of said biasing means when the ambient temperature is above a preselected temperature to maintain said valve member in a closed condition and to exert a force on said valve member less than the force of said biasing means when the ambient temperature falls below said preselected temperature to thereby permit said valve member to open under the influence of said biasing means, said pressure responsive element comprising a casing containing a mass of material capable of substantial expansion and contraction within a preselected temperature range, said temperature responsive element also including a plunger slidable relative to said casing and operably connected to said mass, said cover including an outwardly extending projection defining an internal recess, said plunger being disposed in said internal recess and engaged with said cover.

* * * * *